United States Patent [19]

Latimer

[11] 4,018,424

[45] Apr. 19, 1977

[54] WINCH DISCONNECT CONTROL ARRANGEMENT

[75] Inventor: Robert M. Latimer, Canton, Ill.

[73] Assignee: Caterpillar Tractor Co., Peoria, Ill.

[22] Filed: July 11, 1975

[21] Appl. No.: 595,479

[52] U.S. Cl. ..... 254/187.1; 74/476

[51] Int. Cl.[2] ..... B66D 1/00

[58] Field of Search ..... 254/166, 185 A, 187 R, 254/187 D, 187 H, 173 R; 242/86.51; 192/12 A, 91 A; 74/476, 483 R, 519, 532, 477; 180/6.32, 82 A

[56] References Cited

UNITED STATES PATENTS

| | | | |
|---|---|---|---|
| 1,121,838 | 12/1914 | Haff | 74/476 |
| 1,557,134 | 10/1925 | Barthel | 74/532 |
| 1,618,936 | 2/1927 | Lockwood | 74/532 |
| 1,938,780 | 12/1933 | Nenninger et al. | 192/91 A |
| 2,588,565 | 3/1952 | Pealer | 74/532 |
| 2,937,541 | 5/1960 | Barlow | 74/532 |
| 3,107,899 | 10/1963 | Henneman | 254/187 H |
| 3,636,793 | 1/1972 | Bieber | 74/476 |
| 3,697,049 | 10/1972 | Wallace | 192/91 A |
| 3,848,852 | 11/1974 | Therkildsen | 192/91 A |
| 3,915,433 | 10/1975 | Therkildsen | 254/187 R |

*Primary Examiner*—Robert J. Spar
*Assistant Examiner*—Kenneth Noland
*Attorney, Agent, or Firm*—Phillips, Moore, Weissenberger, Lempio & Majestic

[57] ABSTRACT

A construction vehicle, such as a track-type tractor, has a winch assembly mounted thereon for selectively paying-out cable from a cable drum thereof. A first hydraulic control for selectively rotating the cable drum comprises a pair of winch clutches adapted to brake the cable drum when both clutches are engaged, rotate the cable drum in one direction when only one clutch is engaged and rotate the cable drum in a second opposite direction when only the other one of the clutches is engaged. The above operations are responsive to movement of a single first handle mounted on an operator's station of the vehicle. A second hydraulic control is operatively connected to a disconnect clutch, normally completing the drive input from the winch clutches to the cable drum. Upon movement of a second handle of the second hydraulic control to disengage the disconnect clutch, a retaining means automatically entraps the first handle to prevent movement thereof. Such entrapment insures engagement of the disconnect clutch by the second handle prior to movement of the first handle for winch clutch actuation purposes.

15 Claims, 9 Drawing Figures

Fig. 6
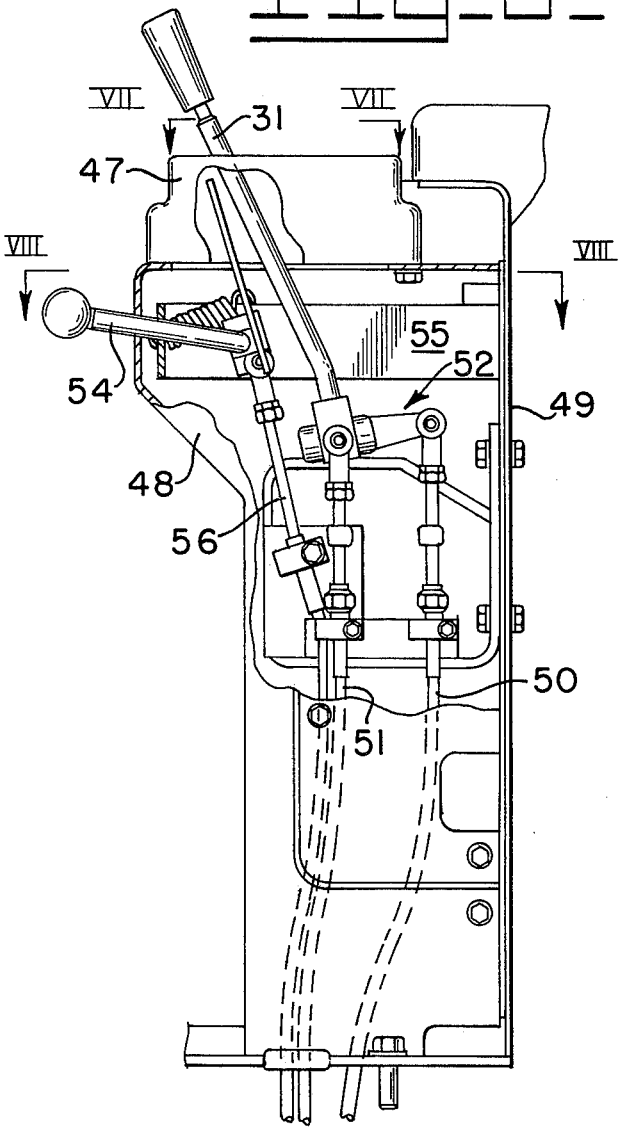
Fig. 7
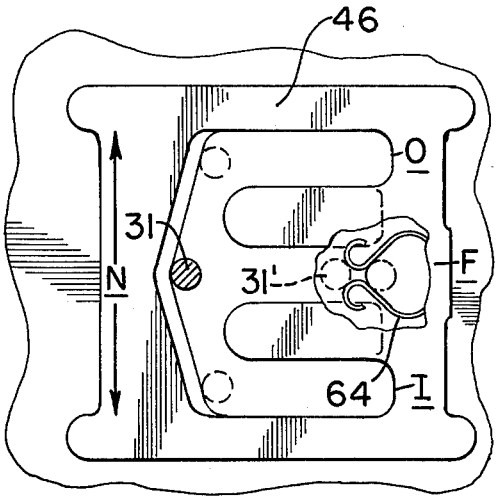
Fig. 9
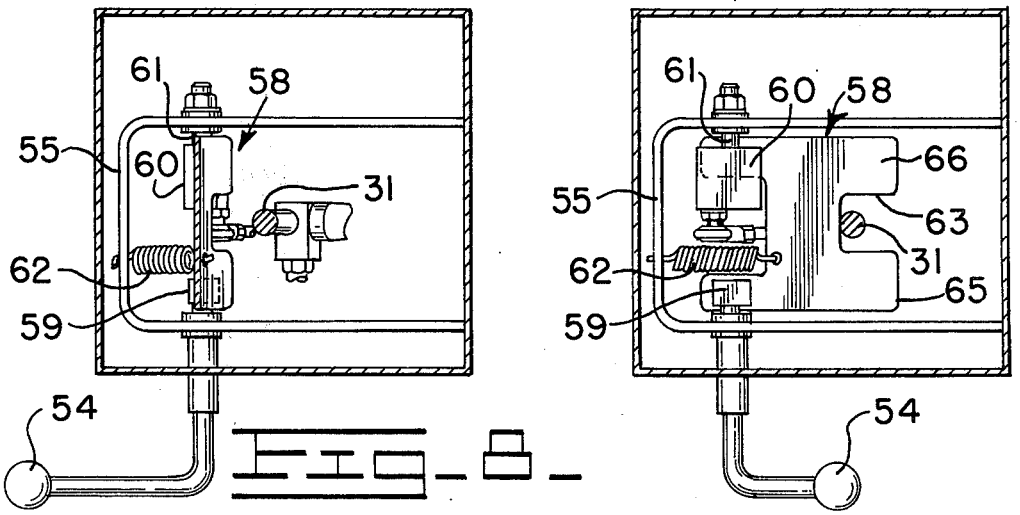
Fig. 8

WINCH DISCONNECT CONTROL ARRANGEMENT

BACKGROUND OF THE INVENTION

This invention relates to a control arrangement for towing winches of the type used in the construction, logging, pipeline-laying, mining and reclamation industries.

A conventional winch is normally actuated by a power take-off from the engine of a construction vehicle on which the winch is mounted. A typical winch of this type is disclosed in U.S. Pat. No. 3,729,171 wherein a pair of winch clutches are operatively connectible to a cable drum to place the winch in the following modes of operation: "Reel-out" wherein only one of the winch clutches is engaged to pay-out the cable by rotating the drum in a first direction; "Reel-in" wherein only the other one of the winch clutches is engaged to rotate the cable drum in a second opposite direction; or "Brake-on" wherein both of the winch clutches are engaged to prevent rotation of the cable drum. It has been found desirable to further employ a disconnect clutch of the type disclosed in U.S. Pat. No. 3,848,852, for example, in the drive train between the winch clutches and the cable drum to permit the cable drum to "freewheel" upon disconnection of the disconnect clutch.

It has been found further desirable to provide control means for actuation of such disconnect clutch. When the disconnect clutch is in its disengaged condition of operation, inadvertent movement of the control handle for the winch clutches to place them in their reel-in or reel-out mode of operation could expose the disconnect clutch to damage upon re-engagement thereof. This possibility is particularly apparent with respect to a disconnect clutch of the axially engaging positive-type.

SUMMARY OF THIS INVENTON

An object of this invention is to provide an improved control system for a winch assembly of the above-described type which facilitates expeditious and precise control by an operator. The winch assembly comprises a rotatable cable drum with drive means normally connectible therewith for selectively rotating the cable drum by a first control means. Disconnect means are provided for selectively disconnecting the drive means from the cable drum and second control means selectively engage or disengage the disconnect means.

A novel aspect of this invention comprises the provision of retaining means operatively associated with the second control means for preventing actuation of the first control means when the second control means disengages the disconnect means. The first and second control means each preferably comprise a handle movably mounted on an operator's station of a construction vehicle with the retaining means being operatively connected to the handle of the second control means for movement therewith. Another novel aspect of this invention is the mounting of the two control handles in close proximity to each other on an operator's station of a vehicle.

BRIEF DESCRIPTION OF THE DRAWINGS

Other objects of this invention will become apparent from the following description and accompanying drawings wherein:

FIG. 6 is a partially sectioned side elevational view of handles and attendant linkages employed in such control system;

FIG. 7 is a top plan view, taken in the direction of arrows VII—VII in FIG. 6, of a guide plate for one of the handles employed for selectively actuating the input and winch clutches of the control system;

FIG. 8 is a top plan sectional view, taken in the direction of arrows VIII—VIII in FIG. 6; and FIG. 9 is a view similar to FIG. 8, but showing the relative positions of a handle for the disconnect clutch and a retaining plate employed therewith upon disengagement of such clutch.

DETAILED DESCRIPTION

Figure 1:
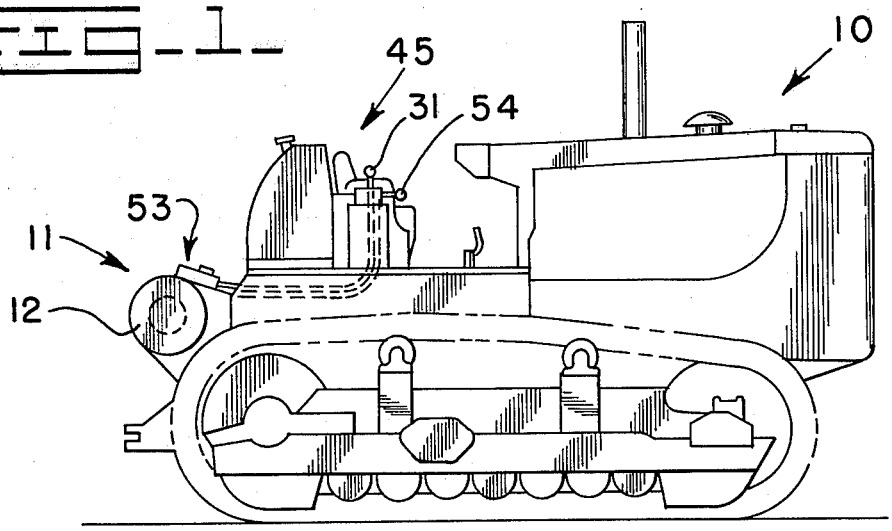
FIG. 1 is a side elevational view of a track-type tractor having a winch assembly and control system therefor mounted thereon.
Figure 2:
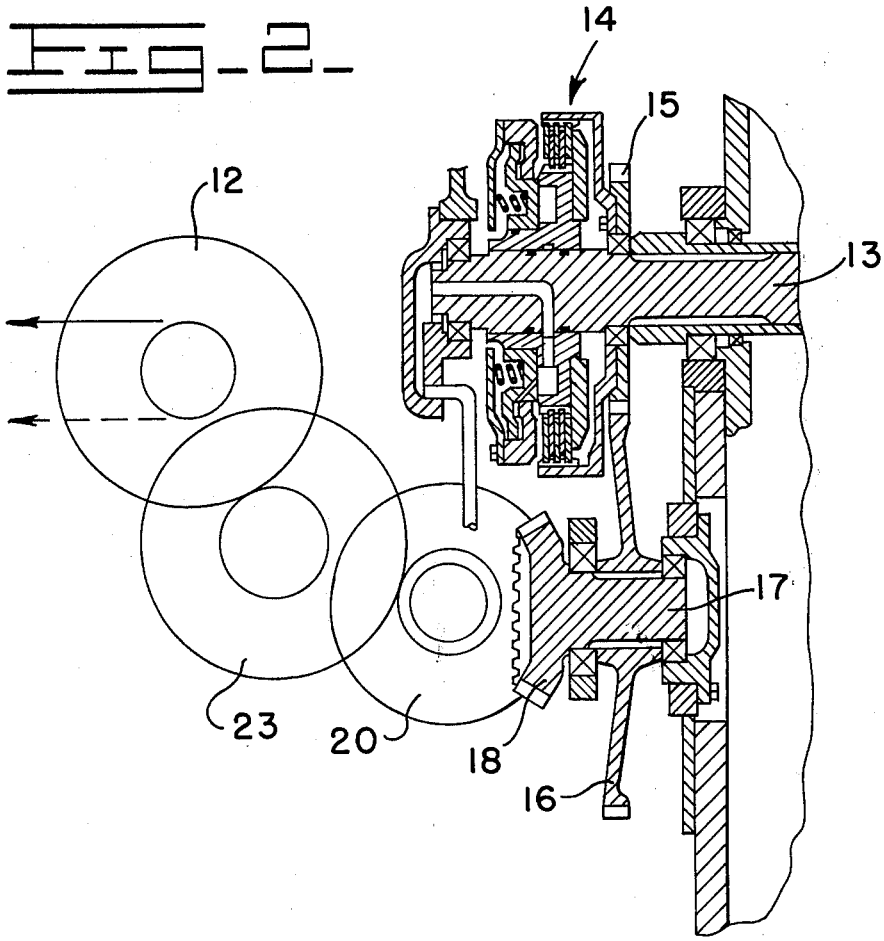
FIG. 2 is a sectional view through a portion of a drive train employed to selectively rotate a cable drum of the winch assembly.

Referring to FIG. 1, a construction vehicle or track-type tractor 10 has a winch assembly 11 mounted on a rearward end thereof. The winch assembly comprises a cable drum 12 adapted to be rotated by a drive means, including a power input means or shaft 13 (FIG. 2) constituting a standard power take-off from an internal combustion engine (not shown). A normally disengaged input clutch means 14 may be actuated to couple input shaft 13 with winch input means comprising a gear 15 which meshes with a gear 16 splined to a rotatable shaft 17.

Figure 3:
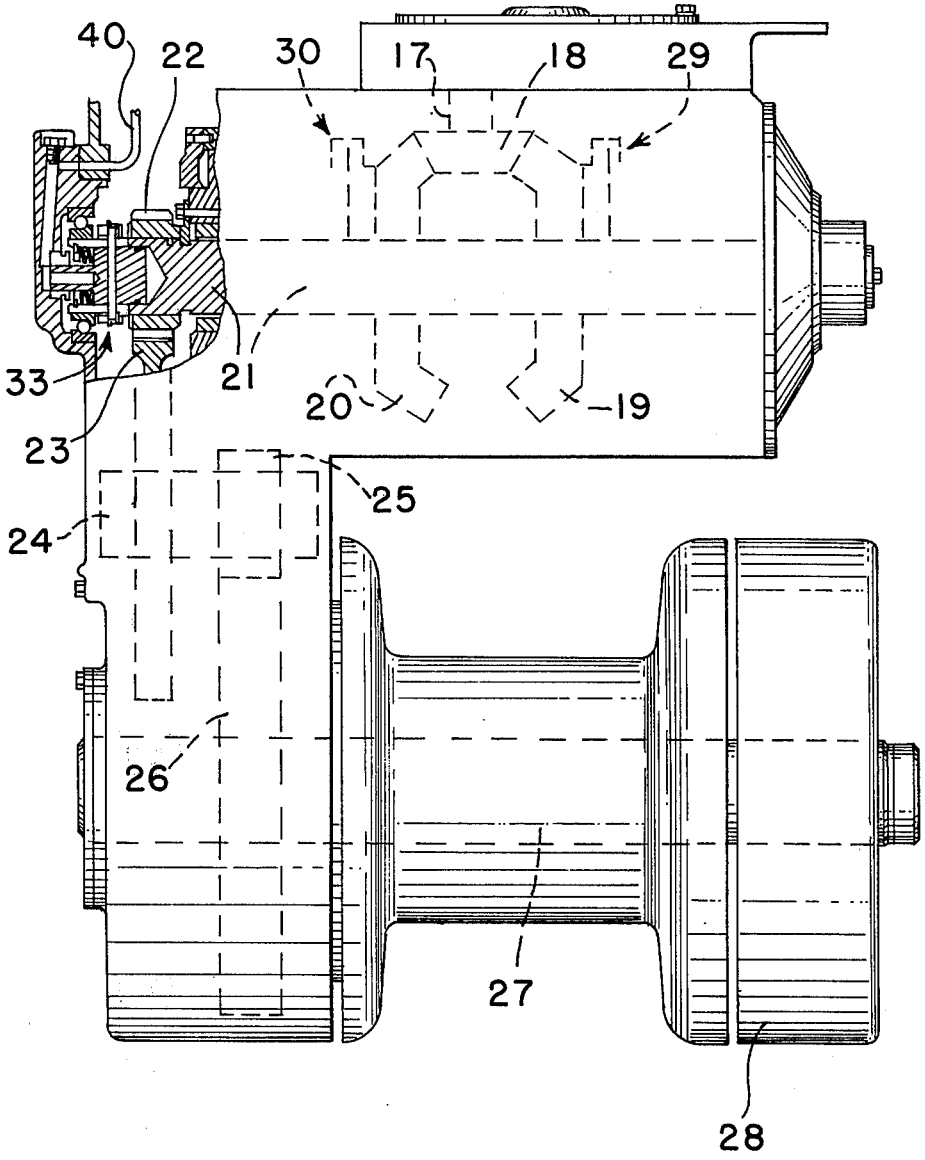
FIG. 3 is an enlarged and partially sectioned top plan view of the winch assembly.

Shaft 17 has a bevel gear 18 secured on an end thereof to mesh with a pair of bevel gears 19 and 20, rotatably mounted on a countershaft 21 of the winch assembly (FIG. 3). The shaft has a pinion gear 22 rotatably mounted on the end thereof and meshing with a spur gear 23, secured to a shaft 24 rotatably mounted on the winch assembly. A second gear 25 is secured to shaft 24 to mesh with a gear 26 secured to a shaft 27, rotatably mounted in the winch assembly and carrying a cable drum 28 thereon.

The above, briefly described drive means for cable drum 28 is more fully described in U.S. Pat. No. 3,729,171. Such patent further describes a first control means for selectively actuating such drive means and, in particular, for selectively actuating input clutch 14 (FIG. 2) and a pair of winch clutches 29 and 30 (FIG. 3).

In general, the control means functions to condition the winch assembly and control system therefor for the following modes of operation in response to actuation of a first control handle 31 (FIG. 7): "Neutral" (N) wherein the lever is positioned, as illustrated, to engage winch clutches 29 and 30 and to disengage input clutch 14; "Reel-out" (O) wherein the handle is moved rightwardly in one slot to disengage winch clutch 29 only and to engage the input clutch to rotate cable drum 28 in a first direction to pay-out cable therefrom; "Reel-in" (I) wherein the handle is moved rightwardly in the other slot to disengage winch clutch 30 only and to engage the input clutch to rotate the cable drum in a second, opposite direction to reel-in in the cable; and "Free-spool" (F) wherein all of the clutches are disengaged to permit the drum to rotate freely.

Figure 4:
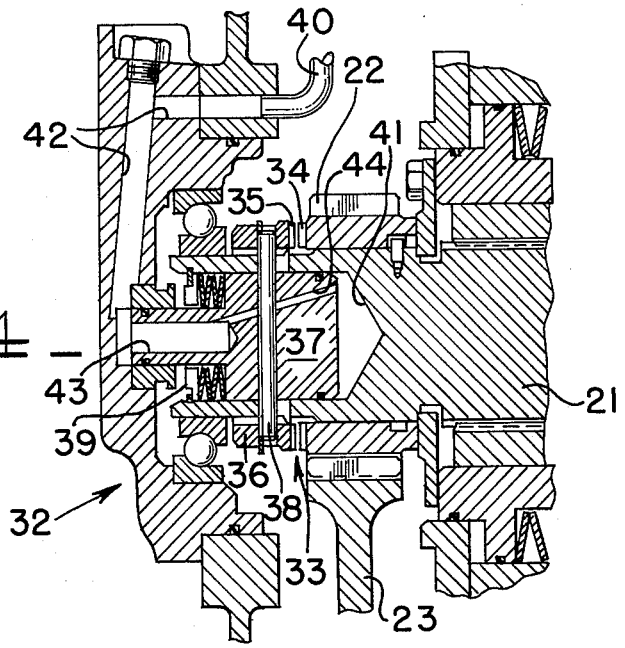
FIG. 4 is an enlarged sectional view of a disconnect clutch employed in the winch assembly and exposed in FIG. 3 by a section line.

Referring to FIGS. 3 and 4, a disconnect means 32 is operatively connected in the drive means for the cable drum, between countershaft 21 and gear 23, for selectively disconnecting the drive means from the cable drum. Such disconnect means, fully described in U.S. Pat. No. 3,848,852, essentially comprises a positive, axially engaging clutch 33 including a plurality of circumferentially disposed teeth 34 formed on the outboard side of gear 22 and a plurality of matched teeth 35 formed on the inboard side of an annular connecting member 36. Member 36 is connected to a piston 37 for simultaneous axial movement therewith by a cross-pin 38.

Clutch 33, shown in its disengaged condition of operation, is normally biased to its engaged condition to intermesh teeth 34 and 35 by spring means comprising a plurality of stacked Belleville spring washers 39. In order to disengage the clutch, pressurized hydraulic fluid is communicated from a conduit 40 and into an actuating chamber 41 via passages 42, 43 and 44. In the illustrated disengaged condition of clutch operation, gear 22 is conditioned to freely rotate on shaft 21 whereby a workman can readily pull cable from cable drum 28 and return to an operator's station 45 of the tractor (FIG. 1) to commence a towing operation, for example.

Figure 5:
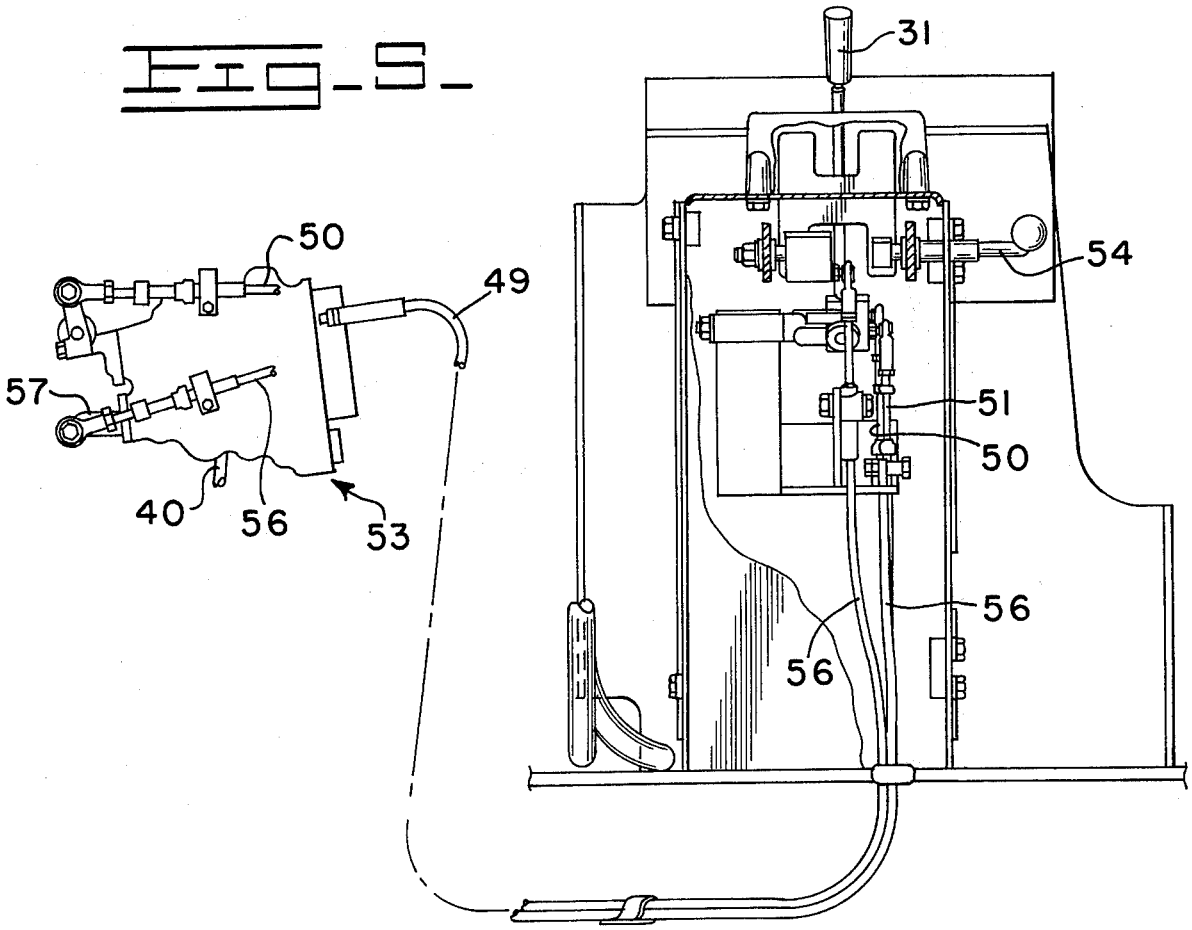
FIG. 5 illustrates a portion of a control system for selectively actuating the winch assembly.

As shown in FIGS. 5 and 6, control handle 31 extends upwardly through a slotted plate 46 defining the above-described work positions N, I, F and O. The plate is formed integrally with a cover 47 attached to a support structure 48 secured to a panel 49 of the vehicle, located at the operator's station thereof. The handle is pivotally mounted on the vehicle to selectively actuate push-pull cables 50 and 51 via standard linkage means 52. The cables are adapted to selectively shift the appropriate spools mounted in a directional control valve 53 to, in turn, selectively actuate clutches 14, 29 and 30. A typical hydraulic control system for use herein is fully described in above-referenced U.S. Pat. No. 3,729,171.

As briefly mentioned above, movement of handle 31 in FIG. 7 to a reel-in (I) or reel-out (O) position would set shaft 21 in motion along with gear 22. Although the gear is rotatably mounted on the shaft, surface friction therebetween would cause the gear to rotate with the shaft. Should the operator then engage clutch 33 by depressurizing actuating chamber 41 to permit spring means 39 to move piston 37 rightwardly to engage clutch teeth 34 and 35, the teeth could be damaged.

A second control handle 54 is rotatably mounted on a bracket 55 secured to stationary enclosure 48. The handle, adapted to selectively actuate disconnect clutch 33, is shown in its first or engaged position in FIGS. 6 and 8 and its second or disengaged position in FIG. 9. The second control handle is pivotally connected to a push-pull cable 56 which is further connected to a valve spool 57 reciprocally mounted in directional control valve 53 to selectively communicate pressurized fluid to chamber 41 or exhaust such fluid therefrom.

Retaining means, preferably in the form of a flat plate 58, has a bifurcated rearward end which is secured to handle 54 for simultaneous movement therewith about a common pivot axis. In particular, an inner end 59 of the handle is secured to one side of plate 58 to pivot the same on bracket 55. The opposite side of the plate is secured to a block 60 which is, in turn, secured to a pivot pin 61 pivotally mounted on bracket 55 and aligned with end 59 of the handle.

Spring means 62, preferably in the form of a retraction coil spring, is interconnected between bracket 55 and plate 58 to normally retract the plate to its locked FIG. 6 "over-center" position. Upon movement of the handle to its FIG. 9 position, the spring means will be displaced to an "under-center" position beneath the pivot axis of handle 54 to lock plate 58 in its lowered and disengaged position. As shown in FIGS. 7 and 9, when the plate is disposed in its lowered position, a notch 63 formed on the forward end thereof will entrap handle 31 therein to prevent movement thereof to any of its N, I or O positions. Thus, the operator must return handle 54 and plate 58 to their FIG. 6 positions to engage disconnect clutch 33 prior to actuation of handle 31 to actuate either one or both of the winch clutches.

It should be further noted that when handle 31 is disposed in its FIG. 7 position and handle 54 is moved from its FIG. 6 to its FIG. 9 position that the plate will move handle 31 automatically to its dotted-line 31' position in FIG. 7. A spring clip 64 may be secured to cover 47 to retain handle 31 in its free-wheel (F) position whereby the winch clutches are disengaged. Also, should handle 31 be in either its reel-in (I) or reel-out (O) position, a respective leg 65 or 66 of plate 58 will engage handle 31 to prevent the operator from disengaging clutch 33, i.e., rotation of handle 54 to its FIG. 9 position will be prevented.

In operation, an operator will position the tractor adjacent to an object adapted to be connected to the cable of cable drum 28. He will then actuate handle 54 to disengage clutch 33 to entrap handle 31 within notch 63 of plate 58. Thus, the winch and input clutches are disengaged. The operator may then descend from the vehicle and pull the cable from the cable drum by hand which may be easily effected due to the free-wheeling condition of the cable drum and, in particular, disconnection of gear 22 from shaft 21. Upon proper positioning of the cable, the operator will then remount operator's station 45 and return handle 54 to its FIG. 6 Position whereby clutch 33 is re-engaged with teeth 34 and 35 being in substantial static condition to prevent damage thereto. The operator is then free to perform his various operations with handle 31 for the control of the input and winch clutches.

I claim:

1. In a winch assembly and control system therefor comprising a rotatable cable drum, drive means normally connectible to said cable drum for selectively rotating the same, first control means, including a first control handle movable between various operational positions, for selectively actuating said drive means to rotate said cable drum, disconnect means for selectively disconnecting said drive means from said cable drum, and second control means, including a second control handle, for selectively engaging or disengaging said disconnect means, the improvement comprising retaining means connected to said second control handle for simultaneous movement therewith for preventing actuation of said first control means when said second control means is actuated to disengage said disconnect means and for permitting actuation of said first control means when said second control means is actuated to engage said disconnect means, said retaining means further operational for automatically engaging and moving said first control handle upon movement of said second control handle only when said first control handle is in one of said operational positions.

2. The invention of claim 1 wherein said drive means comprises a power input means, winch input means, a normally disengaged input clutch means adapted to be actuated to couple said power input means to said winch input means, and first and second winch clutch means operatively connectible between said cable drum and said winch input means for selectively rotating said cable drum and wherein said first control means is operative for: simultaneously engaging said input clutch means and for only disengaging said first winch clutch means to rotate said cable drum in a first direction; or for simultaneously engaing said input clutch means and for only disengaging said second winch clutch means to rotate said cable drum in a second direction opposite to said first direction; or for simultaneously disengaging said first and second winch clutch means.

3. The invention of claim 1 wherein said first control handle is movably mounted on a support and wherein said second control handle is mounted on said support adjacent to said first control handle.

4. The invention of claim 3 wherein said first control handle projects through a slotted plate means for guiding control movements thereof and wherein said retaining means comprises a retaining member operatively connected to said second control handle for simultaneous movement therewith and positioned for engagement with said first control handle.

5. The invention of claim 4 wherein said second control handle and said retaining member are each pivotally mounted on said support for movement about a common pivot axis between a first position engaging said disconnect means and a second position disengaging said disconnect means.

6. The invention of claim 5 further comprising spring means interconnected between said support and said retaining member for holding said retaining member in a locked over-center or under-center position relative to said pivot axis in said first and second positions thereof, respectively.

7. The invention of claim 5 wherein said retaining member constitutes a flat plate having a notch formed on one end thereof to engage and entrap said first control handle therein upon movement of said second control handle from its first position towards its second position.

8. The invention of claim 3 further comprising retaining clip means mounted on said support adjacent to said first control handle for selectively holding the same therein.

9. The invention of claim 1 wherein said disconnect means comprises a positive, axially engaging clutch.

10. In a construction vehicle having an operator's station mounted thereon, a winch assembly and control system therefor comprising a rotatable cable drum, drive means normally connectible to said cable drum for selectively rotating the same, first control means, including first handle means movably mounted on said operator's station and projecting through a plate means having a plurality of slots formed therethrough for guiding control movements of said first handle means, for selectively actuating said drive means, disconnect means for selectively disconnecting said drive means from said cable drum and second control means, including second handle means movably mounted on said operator's station closely adjacent to said first handle means, for selectively engaging or disengaging said disconnect means and retaining means responsive to actuation of said second control to disengage said disconnect means for preventing actuation of said first control means comprising a retaining member disposed beneath said plate means and connected to said second handle means for simultaneous movement therewith from a first position projecting at least generally upwardly towards said plate means to a second position whereat said retaining member is disposed in underlying and at least generally parallel relationship relative to said plate means for preventing movement of said first handle means.

11. The vehicle of claim 10 wherein said second handle means and said retaining member are each pivotally mounted on said operator's station for movement about a common pivot axis between said second position engaging said disconnect means and said first position disengaging said disconnect means.

12. The vehicle of claim 11 further comprising spring means interconnected between said operator's station and said retaining member for holding said retaining member in a locked over-center position relative to said pivot axis in each of the first and second positions thereof.

13. The vehicle of claim 11 wherein said retaining member constitutes a flat plate having a pair of legs formed thereon to define a notch therebetween on one end thereof to engage and entrap said first handle means in said notch upon movement of said second handle means from its first position towards its second position and for preventing such movement of said second handle means when it is otherwise aligned in the slots formed through said plate means.

14. The vehicle of claim 10 further comprising retaining clip means mounted on said operator's station adjacent to said first handle means for selectively holding the same therein.

15. The vehicle of claim 10 wherein said disconnect means comprises a positive, axially engaging clutch.

* * * * *